United States Patent [19]

Otte

[11] 4,426,075

[45] Jan. 17, 1984

[54] EMERGENCY SHUT-OFF SWITCH FOR EXERCISE APPARATUS

[75] Inventor: Gary Otte, Brazil, Ind.

[73] Assignee: Nissen Corporation, Cedar Rapids, Iowa

[21] Appl. No.: 49,618

[22] Filed: Jun. 18, 1979

[51] Int. Cl.[3] ..... A63B 23/06

[52] U.S. Cl. ..... 272/69; 272/DIG. 4

[58] Field of Search ..... 272/69; 200/153 H, 332, 200/335, 157; 191/1 R, 1 A

[56] References Cited

U.S. PATENT DOCUMENTS

| | | | |
|---|---|---|---|
| 921,755 | 5/1909 | Volk . | |
| 937,795 | 10/1909 | Hackney | 272/69 |
| 2,370,420 | 2/1945 | Rayburn | 191/1 R X |
| 2,399,915 | 5/1946 | Drake | 272/69 |
| 3,332,683 | 7/1967 | Rand . | |
| 3,518,985 | 7/1970 | Quinton . | |
| 3,643,943 | 2/1972 | Erwin, Jr. . | |
| 3,659,845 | 5/1972 | Quinton . | |
| 3,711,812 | 1/1973 | Cherry | 272/69 X |
| 3,731,917 | 5/1973 | Townsend . | |
| 3,737,163 | 6/1973 | Sumrall . | |

FOREIGN PATENT DOCUMENTS

| | | | |
|---|---|---|---|
| 1114558 | 10/1961 | Fed. Rep. of Germany | 191/1 R |

*Primary Examiner*—Robert A. Hafer
*Assistant Examiner*—Arnold W. Kramer
*Attorney, Agent, or Firm*—Fleit, Jacobson, Cohn & Price

[57] ABSTRACT

A safety switch for use with a personal exercise machine, of the type having a driven endless belt, permits the drive motor to be shut off immediately by a quick downward thrust by the user of two prominent handles. The extent of travel of the linkage in the switch system is extremely short and the pressure necessary to actuate the safety switch is adjustable. Downward thrust of the handles, by overcoming an adjustable tension spring, frees the switch actuating lever so that the switch is biased to an open position thereby breaking the circuit to the drive motor.

11 Claims, 6 Drawing Figures

EMERGENCY SHUT-OFF SWITCH FOR EXERCISE APPARATUS

BACKGROUND OF THE INVENTION

The present invention relates to an emergency switch for shutting off a system and, more particularly, relates to an emergency switch for quickly deactivating exercise apparatus.

The machine denoted as a treadmill has been known for many centuries. Originally, the treadmill was used to obtain a motive force through the action of a human or an animal walking on the endless belt of the treadmill. Even though the treadmill is not an efficient device in modern times for producing motive power, nevertheless, treadmills are still quite evident. The modern treadmill is the same ancient machine, however, it is operated in the reverse direction, i.e., as a motor instead of as a generator.

The treadmill today is utilized as an exercising device, wherein an electric motor is employed to drive the endless belt, thereby forcing the person utilizing the machine to move his or her legs at a rate which will prevent the person from being thrown off the exercise device. In a typical operation of an exercise machine, the participant or an attending personnel selects the desired walking or running speed, and the endless belt is driven at a rate corresponding to this selected walking speed. In order to cause the participant to exert more energy, the rate is increased until a brisk walk or a run is involved.

Another current use for the exercising machine is the now popular "stress test", which is employed to determine the extent of the stresses placed upon a person's cardiovascular system by strenuous exercise. A stress test may be conducted by a physician as a part of a person's routine physical check-up. It has also become the practice today for health fitness facilities to request that the members undergo a stress test, prior to engaging in a continuous program of exercise, such as jogging, swimming, or working out, at the health spa. Typically, a person exercises on the treadmill and the heart rate, blood pressure, and the like, are monitored to determine if the person is capable of undergoing strenuous exercise and at what level of exercise the person's activities should be diminished.

Needless to say, it is an important consideration in the use of an exercise device, such as a motor-driven treadmill, that when one desires to stop the treadmill, such action should occur immediately. In the even that the belt is being driven at a speed which is higher than the participant can achieve and maintain comfortably, quite frequently the participant is forceably thrown from the belt. This is, of course, an uncomfortable situation and may easily result in an injury. Additionally, when the exercise device is being utilized in the stress-test situation, it is possible that a person may feel uncomfortable and in fact be aware that he is being stressed above his limitations before the health personnel can determine that this is the case. In such situations, the machine should be immediately shut off to prevent overstressing the participant.

Typical exercise machines, of course, employ an on-off switch; however, such switches are either inaccessible or difficult to manipulate immediately, so as to instantaneously stop the action of the endless belt.

BRIEF SUMMARY OF THE INVENTION

The present invention provides an emergency switch for use on exercise apparatus, which is easily actuable by the participant and which serves to stop immediately the drive function of the endless belt. The exercise apparatus is provided with large protruding handles, which are of a curved design, and which may be easily actuated by the participant. The extent of travel necessary to activate the safety switch is extremely short and, thereby, permits almost instantaneous action. Upon actuating the safety switch, the main-power relay, which connects the drive motor to the power source, is deactivated. The participant need only exert a vertically downward thrust on the safety handles, in order to actuate the switch. The actuation threshold pressure is adjustable. Because the actuation pressure is adjustable, the handles may be grasped while the participant is using the machine and, in the event that the speed becomes excessive, the participant may merely push downward on the handles and stop the machine. By using the inventive emergency switch, the user of the exercise device may easily also be the operator of the exercise device. Thus, only one person is required to use the exercise machine. A specialized mechanical linkage is connected to the outwardly-protruding, curved handles, which is spring actuated and serves to operate the safety switch.

Therefore, it is an object of the present invention to provide an emergency safety switch for use in exercise apparatus, so that such apparatus may be immediately and instantaneously stopped.

It is also an object of the present invention to provide an emergency safety switch for use in exercise apparatus, which may be actuated with very little travel and permit instantaneous actuation.

It is a further object of the present invention to provide an emergency safety switch for exercise apparatus, which has an adjustable actuation threshold pressure.

It is still a further object of the present invention to provide an emergency safety switch for exercise apparatus which employs safety handles which are both easy to reach and to grasp by the user of the apparatus.

Finally, it is an object of the present invention to provide an emergency safety switch for exercise apparatus, wherein the participant need exert only a downward vertical thrust on the handles to stop the action of the moving endless belt.

The manner in which these and other objects are accomplished in the present invention will be seen from the following detailed description of a preferred embodiment.

DETAILED DESCRIPTION OF THE INVENTION

Figure 1:
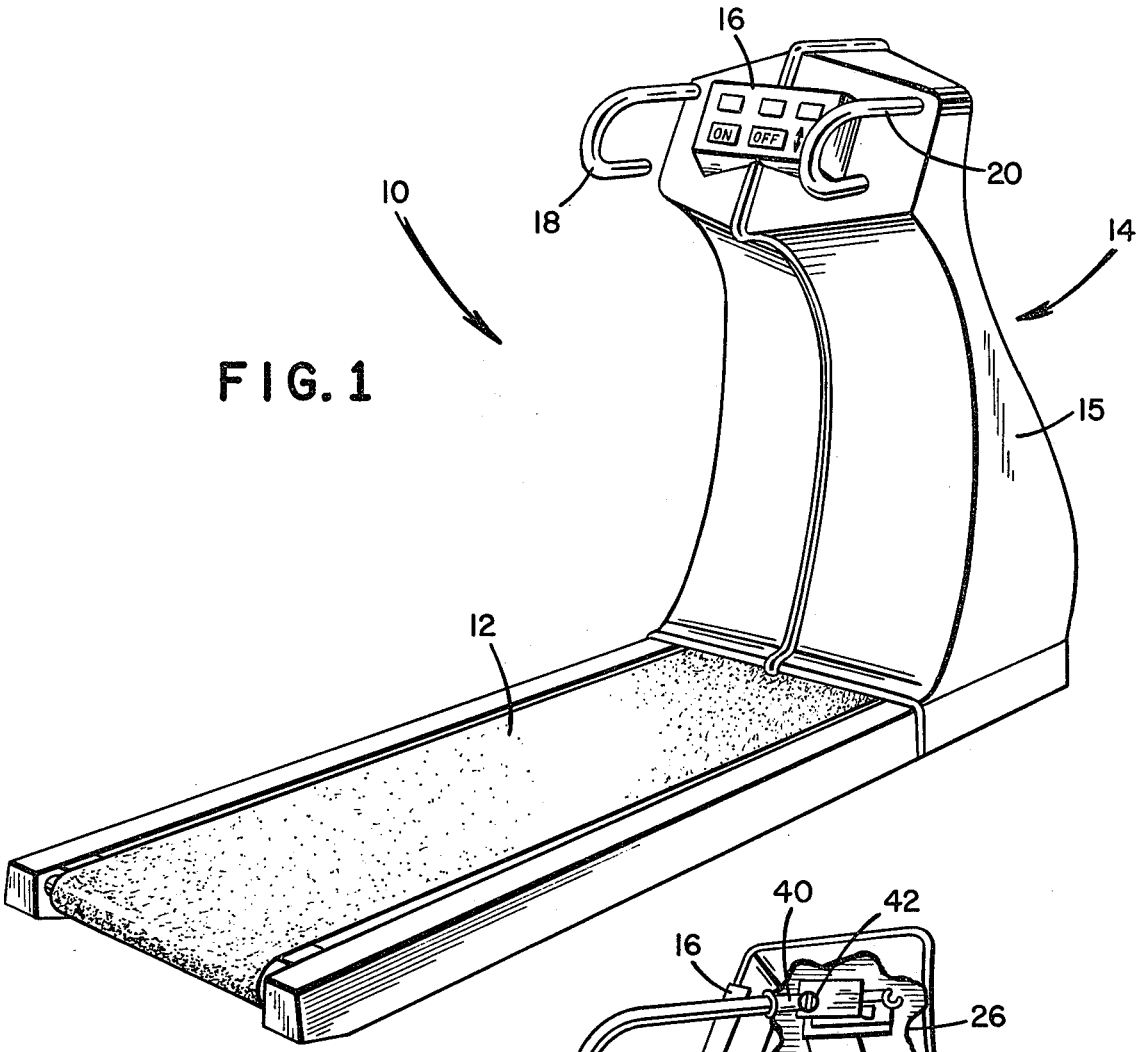
FIG. 1 is a perspective view of a typical exercise machine having the inventive safety switch system installed thereon.

FIG. 1 shows an exercise machine 10 having a moving treadmill or endless belt 12 and an upstanding portion 14, encased in a suitable housing 15. The upraised portion 14 is provided with a control panel 16, which has the conventional on/off switches, speed controls, dials, and lights, normally found in this type of machine. The inventive safety switch system employs two safety handles, 18 and 20. These handles, 18 and 20, are formed of round pipe or steel tubing and have a bent configuration, not unlike the crook of a staff. These handles are connected to the inventive safety switch linkage, which is located inside the upstanding portion 14, beneath the housing 15. To operate the inventive switch system, the participant on the exercise machine need only exert a downward thrust on either or both of the handles, 18 and 20. In this regard, and as may be seen in FIG. 1, the handles are positioned such that not only are the handles easy to grasp and to reach when a person is using the machine, but also the user may simply rest his hands on these handles during the operation of the machine, so that in the event an emergency stop is required, such stop may be quickly and simply effected.

Figure 2:
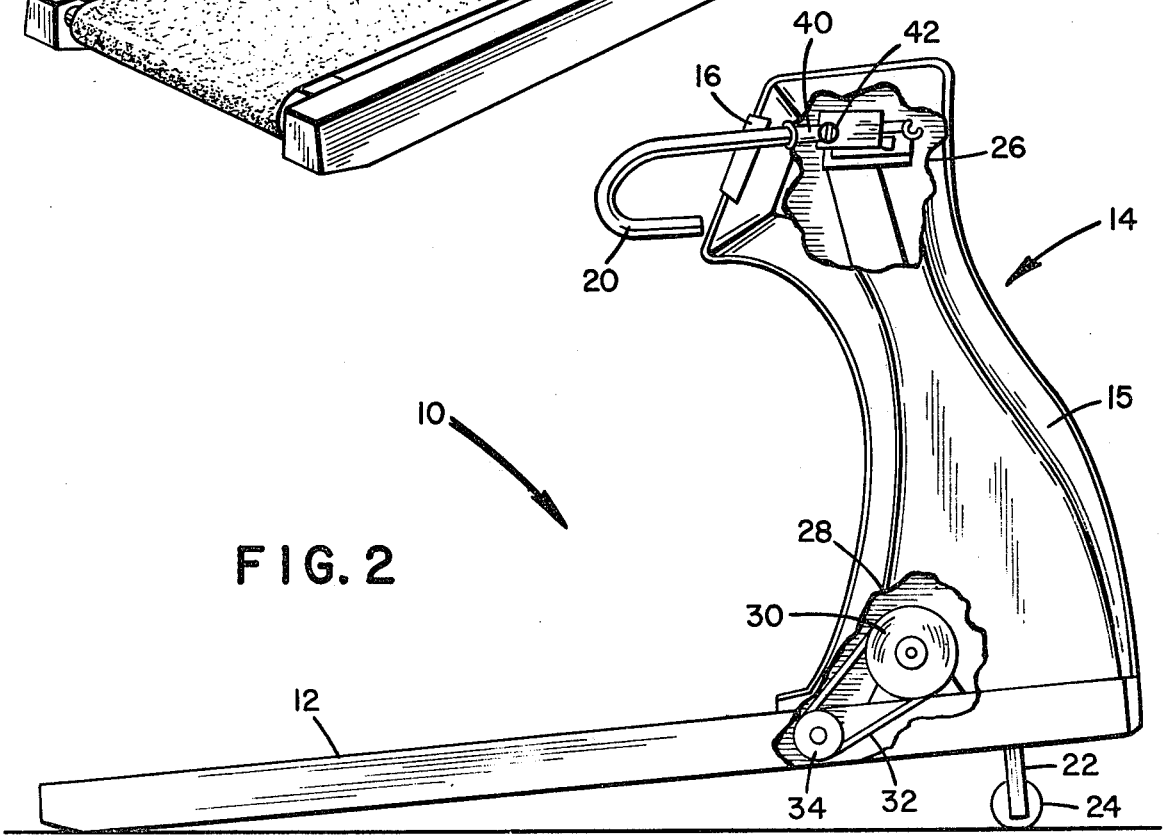
FIG. 2 is a side elevation view of the machine of FIG. 1 having a portion of the housing removed to show the location of the inventive switch system.

FIG. 2 shows the machine 10 of FIG. 1 in a side elevation view, with two portions of the housing cover 15 having been broken away, to show the internal workings of the exercise machine 10. In FIG. 2, it may be seen that the exercise machine is raised from the vertical, by means of an arm 22 and a wheel 24. Another arm and wheel set are arranged on the side of the machine not seen in FIG. 2. This is typical in many exercise machines and represents the ability to adjust the treadmill from a 0% to a 25% grade. By increasing the grade of the endless belt, the amount of effort put forth by the user is also increased. This further aggravates the problem solved by the present invention, since the user is farther above the floor and can be hurt more seriously upon falling. The portion of the housing 15, which has been broken away at 26, shows the location and the internal arrangement of the inventive emergency switch linkage. This will be shown in detail in the subsequent figures. The portion of the housing, which is broken away at 28, reveals the location of the main drive motor 30, which is connected by a belt 32 to a pulley or roller 34, which comprises the drive roller of the endless belt treadmill 12.

Figure 3:
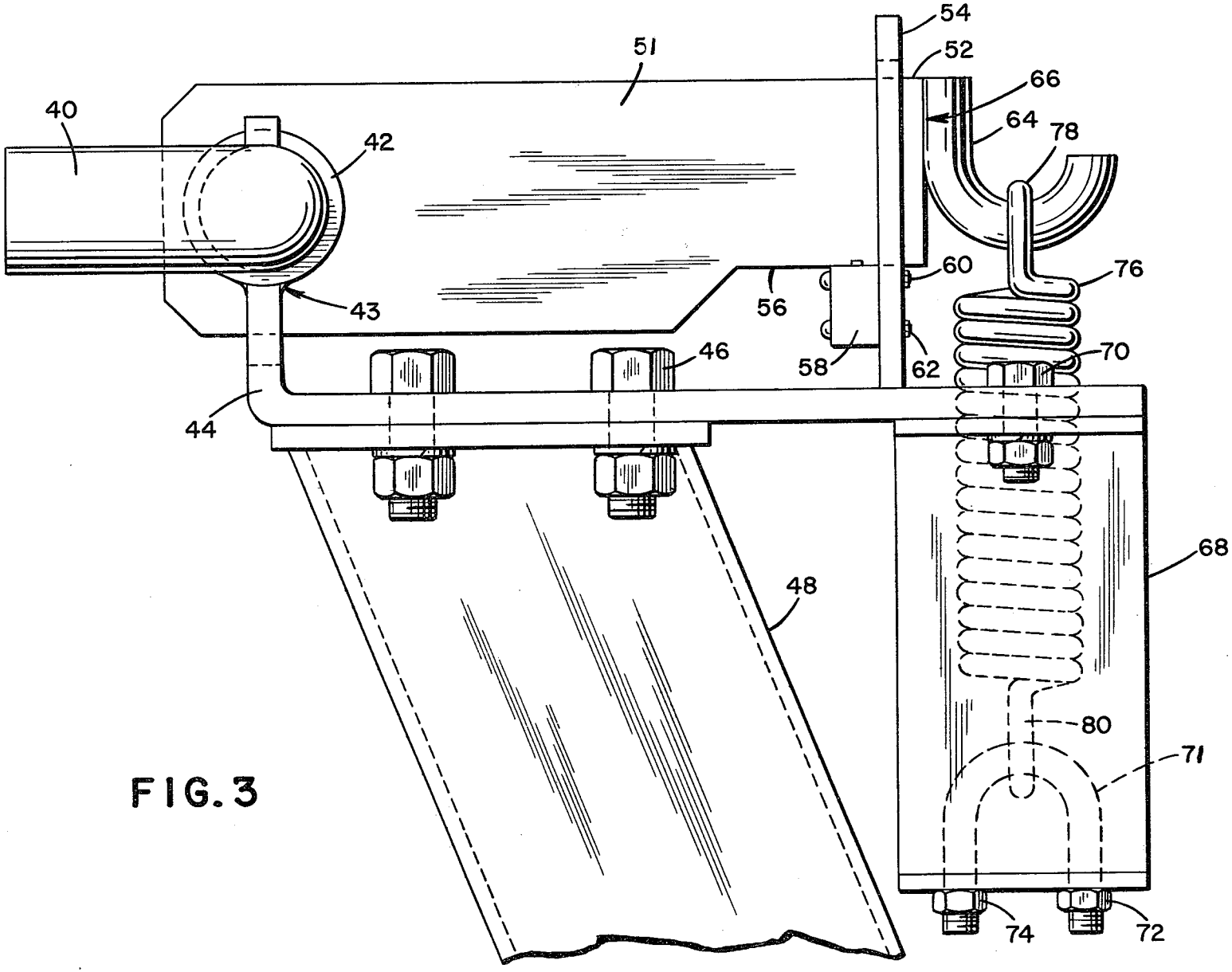
FIG. 3 is a side elevation view showing the inventive safety switch in detail.

Turning then to FIG. 3, the actuation handle, 20 of FIG. 1, is connected internally to a tubular bar 40. Similarly, the handle, 18 of FIG. 1, is connected to the other end of the curved tubular bar. The tubular rod 40 is located by means of a collar 42, which comprises a tube having an inner diameter only slightly larger than the outer diameter of the tube 40. Collar 42 is welded or affixed to an angular bracket 44, which is rigidly bolted, by means of conventional bolts, washers, and nuts, shown typically at 46, to a vertical upright support beam 48. This beam is a hollow, square, tubular member, which forms a major structural portion of the frame of the exercise machine.

The tubular rod 40, after being loosely located by the cylindrical collar 42 is welded at 49 and 50 to an actuating bar 51, which is formed of a solid piece of steel. The rear portion of the bar 51 extends through a stop plate 54, which has an opening through which the rear portion 52 of the bar 51 extends. The rear portion 52 of the bar 51 has a lower surface 56, which serves to actuate the safety switch 58 mounted on the stop plate 54 by bolts and nuts, shown typically at 60 and 62. The manner in which the surface 56 cooperates with the switch 58 will be seen more clearly in FIG. 5. A hook 64 is welded to the rear portion 52 of bar 51 at 66. A mounting bracket 68 is attached to the rear portion of the angle bracket 44 by a bolt and nut arrangement, shown typically at 70. The lower end of bracket 68 is formed with two holes and a U-bolt 71 or shackle bolt is arranged in these two holes and secured at each end, by nuts, 72 and 74, respectively. A specially-formed extension spring 76 is then extended between hook 64 and U-bolt 71. The spring 76 is formed having a 400 pound per inch spring rate and being capable of approximately ½ inch of travel. The threshold actuation pressure is made to be adjustable by means of the threaded U-bolt and the nuts, 72 and 74. By varying the amount of extension of the U-bolt, the extent of spring expansion is varied. This, in turn, varies the amount of pressure needed to extend the spring. Thus, the emergency switch actuation pressure threshold can be adjusted.

Figure 4:
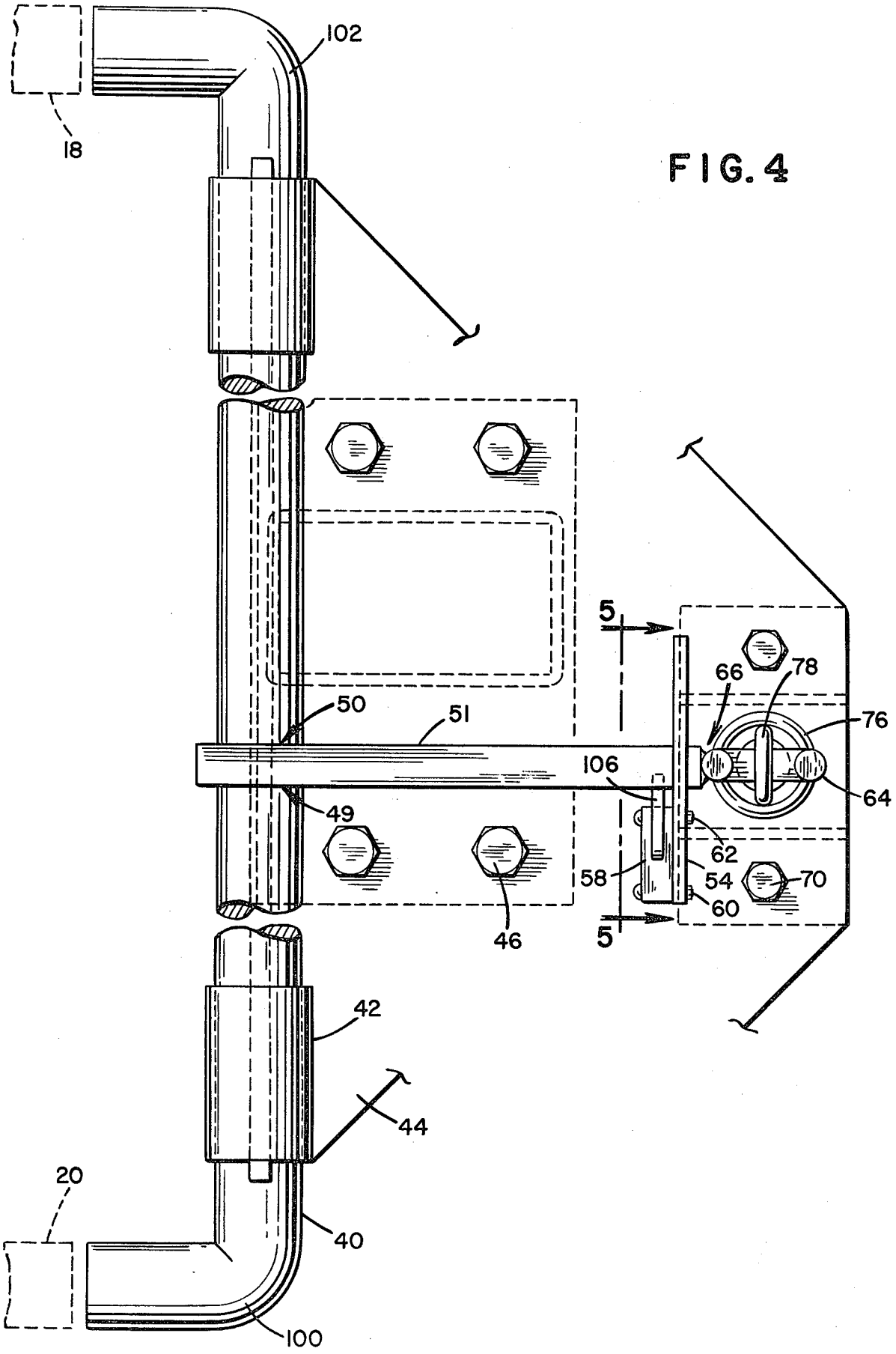
FIG. 4 is a top plan view showing the inventive safety switch in detail.

Turning then to FIG. 4, the inventive safety switch linkage is shown from the top, wherein the loop 78 of the spring 76 is seen to be looped over the hook 64. The hook 64 is welded at 66 to the rear portion 52 of bar 51, which extends towards the front of the machine, where it is welded to the tubular rod 40, at 49 and 50. The tubular rod 40 has a first bend 100 in it at one end to accept handle 20, and a second bend 102 in it to accept handle 18. The switch 58 is bolted to the stop plate 54 and the actuation lever of switch 58 is shown at 106. In order to show the switch 58 and bar 51 arrangement in more detail, reference is made to FIG. 5, which is a cross-sectional view, taken along lines 5—5 in FIG. 4.

Figure 5:
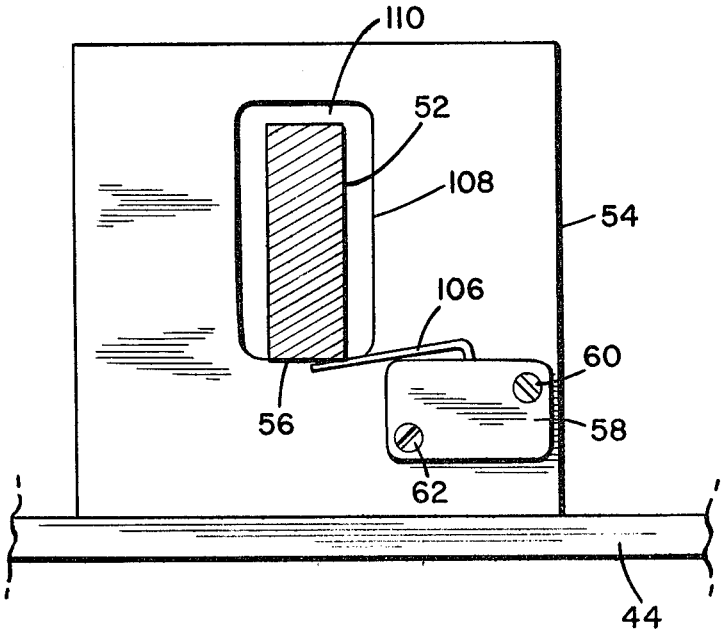
FIG. 5 is a cross-sectional view taken in the direction of the arrows along line 5—5 in FIG. 4.

In FIG. 5, the stop plate 54 is seen to have a central aperture or opening 108 located therein. The opening 108 has a height which is only slightly greater than the height of the operable end 52 of the stop bar 51. The switch 58 is affixed to the stop plate 54 by nuts and bolts, 60 and 62, at a position such that the actuating lever 106 of switch 58 is depressed by the operating end 52 of the bar 51. In this position, the switch contacts are in the closed position. Referring, once again, to FIG. 3, it may be seen that the spring 76 acts to hold the surface 56 of the operable end 52 of bar 51 down against the actuating lever 106 of switch 58, thereby keeping the switch contacts in their closed position. The space 110 at the top of the opening 108 then permits the operable end 52 of bar 50 to be moved upwardly against the action of the spring, thereby permitting switch lever 106 to rise and open the contacts of switch 58.

Figure 6:
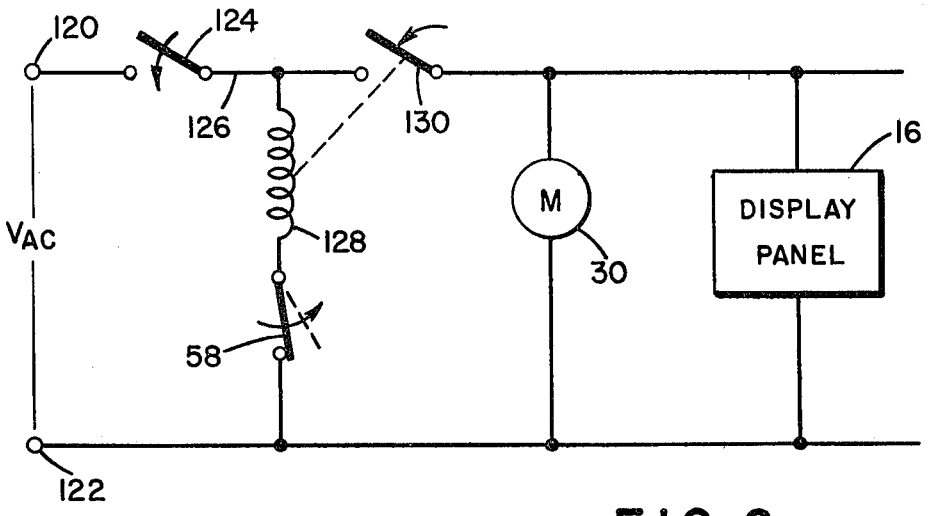
FIG. 6 is a schematic circuit diagram showing the connection of the safety switch into the circuit of the exercise machine.

FIG. 6 is a brief schematic diagram showing the effects of the safety switch 58 on the operation of the exercise machine. The exercise apparatus is connected to a typical source of alternating-current electric power at terminals 120 and 122. An on/off switch 124 is provided and upon actuation of the switch, current is caused to flow in line 126 and will flow through a coil 128 of a relay. Current flowing in coil 128 closes the switch contacts 130 of the relay. This energizes the motor 30 and the meters, lights, and the like, on the display panel 16. The contacts of switch 58 are held in the closed position by action of the bar 51 and the spring 76, which act to depress the lever 106 of switch 58. In this manner, it may be seen that, if the main power switch 124 is closed, then a voltage will appear across relay coil 128, thereby closing the main relay contacts 130, keeping the motor energized. In the event that switch 58 should open, then the voltage is removed from coil 128 and the main relay then drops out and the motor is instantaneously de-energized.

In operation then, the inventive safety switch mechanism acts to interrupt the power to the drive motor 30 of the treadmill 10. More specifically, upon the user or participant exerting a downward pressure on either handle 18 or 20, or on both handles simultaneously, the pressure being in excess of the tension adjusted into spring 76, the bar 51 will be caused to be raised upwardly into the space 110 provided in the stop plate 54, thereby permitting the actuating lever 106 to be raised and open the contacts of switch 58. As may be seen in FIG. 6, the opening of switch 58 then drops out the main power relay and the exercise apparatus is caused to stop.

It is understood, of course, that the foregoing description is presented by way of example only and is not intended to limit the scope of the present invention, except as set forth in the appended claims.

What is claimed is:

1. A safety switch assembly for use with a personal exercise machine of the type having a substantially horizontally arranged endless belt driven by an electric motor, and an upraised housing portion at the front of the machine, said assembly comprising:

handle means protruding from said upraised housing portion and being arranged to be grasped by the person using the machine;

switch means arranged internal to said machine and being electrically connected to disconnect said motor from a power source upon actuation of said switch means from an at-rest position;

linkage means connected between said handle means and said switch means and being located within said upraised housing portion, biasing means, mechanically connected to said linkage means, for retaining said linkage means in a preselected position in which said switch means is in said at-rest position whereby said handle means is arranged with freedom of movement allowing a short travel thereof and upon causing said handle means to undergo said short travel, said linkage means overcomes said biasing means and moves said linkage means from said preselected position so that said switch means moves from said at-rest position to an actuated position thereby disconnecting said motor from the power source, wherein said switch means includes biasing means for urging said switch means from its at-rest position to its actuated position when said handle means moves the predetermined amount.

2. The assembly of claim 1, further comprising means for adjusting the biasing force of said linkage biasing means.

3. The assembly of claim 2, wherein said linkage biasing means is an expansion spring having a spring rate of 400 lbs/inch.

4. The assembly of claim 1, wherein said handle means comprises two tubular members arranged in spaced apart relationship and each being formed as a downwardly pointing crook and, wherein each of said tubular members is mechanically connected to said linkage means.

5. The assembly of claim 1, wherein said linkage means comprises:

an elongated rod mechanically connected to said handle means and being mounted for axial rotation on the frame of said machine, rigid bar means attached to said rod at its center, extending rearwards on said machine, and contacting said switch means, said bar means being connected to said linkage biasing means, such that said switch is maintained in said at-rest position.

6. The assembly of claim 5, further comprising hook means affixed to said bar means for attaching said linkage biasing means to said bar means.

7. The assembly of claim 5, further comprising a stop plate affixed to the frame of the machine and having an aperture located therein through which said bar means passes, wherein said aperture is of a size to limit substantially the extent of travel of said bar means.

8. In an exercise machine of the type having:

an endless belt arranged to be walked upon or run upon by a person using the machine, an electric motor for driving the endless belt, a power source for connecting the motor thereto, an upstanding housing portion at the front of the machine, the improvement wherein:

said housing portion has two hook-shaped handles protruding from the upper portion thereof and facing the endless belt, the handles are affixed to a movable mechanical linkage which is pivotably arranged inside the housing portion and which is connected to a spring which holds the linkage against the actuation lever of a switch, the switch being connected in the circuit of the electric motor such that upon the actuation lever of the switch being actuated the electric motor is disconnected from the power source, and the machine includes means for biasing said actuation lever into a position in which the switch disconnects the electric motor from the power source, whereby upon the person using the exercise machine exerting a force on the handles which is greater than the force of the spring means the linkage is moved so that the switch actuating lever is actuated thereby disconnecting the motor from the power source.

9. A safety switch assembly for use with a personal exercise machine of the type having a substantially horizontally arranged endless belt driven by an electric motor, and an upraised housing portion at the front of the machine, said assembly comprising:

handle means protruding from said upraised housing portion and being arranged to be grasped by the person using the machine;

switch means arranged internal to said machine and being electrically connected to disconnect said motor from a power source upon actuation of said switch means from an at-rest position, said switch means being located within said upraised housing portion and being positioned so that said switch means is actuated upon a predetermined amount of movement of said handle means; and biasing means for retaining said handle means in a preselected position so that the biasing means must be overcome before a force exerted on the handle means moves said handle means said predetermined amount from said preselected position to thereby cause said switch means to move from said at-rest position to an actuated position disconnecting said motor from the power source, wherein said switch means includes biasing means for urging said switch means from its at-rest position to its actuated position when said handle means moves the predetermined amount.

10. The assembly of claim 9, further comprising means for adjusting the biasing force of said handle biasing means.

11. The assembly of claim 9, wherein said handle means comprises two tubular members arranged in spaced apart relationship, and wherein said switch means is positioned to be actuated upon a predetermined amount of movement of either of said tubular members.

* * * * *